US007658697B1

(12) United States Patent
Hsiang

(10) Patent No.: US 7,658,697 B1
(45) Date of Patent: Feb. 9, 2010

(54) TRAMPOLINE FRAME WELDING CONFIGURATION

(76) Inventor: Hua-Lu Hsiang, Da Ping District, Tang-Xia Town, Dong Guan City, Guang Dong (CN)

( * ) Notice: Subject to any disclaimer, the term of this patent is extended or adjusted under 35 U.S.C. 154(b) by 49 days.

(21) Appl. No.: 12/229,648

(22) Filed: Aug. 26, 2008

(51) Int. Cl.
*A63B 21/02* (2006.01)

(52) U.S. Cl. ..... 482/27; 48/28; 48/35

(58) Field of Classification Search ..... 403/192, 403/193, 195, 230, 234, 270–272, 35, 23; 482/27, 28, 33–38
See application file for complete search history.

(56) References Cited

U.S. PATENT DOCUMENTS 1,268,980 A * 6/1918 Krumholz ..... 52/518
1,542,663 A * 6/1925 Brenzinger ..... 138/171
4,916,970 A * 4/1990 McMurtrey ..... 74/551.1
5,403,110 A * 4/1995 Sammann ..... 403/234
5,488,810 A * 2/1996 Horton ..... 52/715
2004/0176214 A1* 9/2004 Yueh ..... 482/27

* cited by examiner

*Primary Examiner*—Jerome Donnelly
(74) *Attorney, Agent, or Firm*—Clement Cheng

(57) ABSTRACT

The present invention is in the field of sports equipment, more specifically, relating to a trampoline frame connection structure. The trampoline frame has a main pipe and a support pipe. The main pipe has a straight line weld seam. The support pipe supports the main pipe. The main pipe junction with the support pipe has a concave connection. The main tube weld seam is on the bottom facing the concave portion. This practical new design features an improved welding configuration that has a low budget and high-efficiency connection. The weld seam on the bottom decreases shock to the weld seam and also prevents interference between the connecting hole on the main pipe and weld seam. Finally, this invention uses a weld seam strengthening plate device.

4 Claims, 2 Drawing Sheets

TRAMPOLINE FRAME WELDING CONFIGURATION

This application claims foreign priority from Chinese national application for Trampoline Frame Welding Configuration having application number 200820049070.6 filed Jun. 12, 2008.

FIELD OF THE INVENTION

The present utility invention relates to trampoline frame structures.

DISCUSSION OF RELATED ART

Trampolines typically have tubular frames which are typically made of several main members arranged in a circle and supporting members supporting the main members. A trampoline bed is secured to the frame. Previously, the bed support was directly welded to main members formed as main tubes. More recently, to improve the Main tubes and to make them cheaper, the main tubes have been constructed of welded sheets. Because the main tube is modularly fashioned, it must connect with other parts and sometimes hole connections are used. When there are hole connections, the hole must not affect the seam so that the main pipe is weakened. Furthermore, a trampoline frame receives a substantial amount of vibration on the Main tubes which have a propensity to cause separation and cracking of the welding seams.

Therefore, an object of the invention is to provide a more stable main welded frame. To fix the above mentioned problems, the present invention for a kind of trampoline uses a specific welding configuration.

SUMMARY OF THE INVENTION

The main member is formed as a main tube or main pipe and supporting member is formed as a supporting tube or supporting tube is improved. The trampoline frame has a main pipe and a support pipe. The main pipe has a straight line weld seam. The support pipe supports the main pipe. The main pipe injunction with the support pipe has a concave connection. The main tube weld seam is on the bottom facing the concave portion.

A plate is welded between the main member and the support member. The plate is welded over the main member and support member 2 interface. The top portion of the reinforcing plate has a concave curvature coaxial to the main member. The bottom portion of the reinforcing plate has a concave curvature coaxial to the support member, which is perpendicular to the main member axis.

DETAILED DESCRIPTION OF THE PREFERRED EMBODIMENTS

Figure 1:
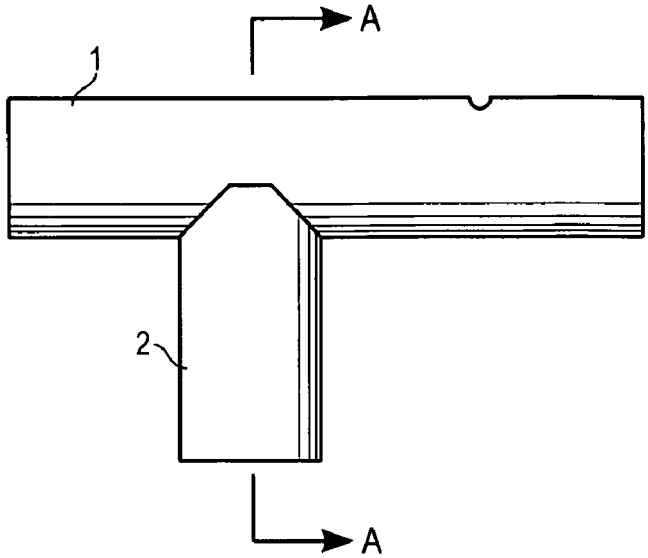
FIG. 1 is a side view of the present invention.
Figure 2:
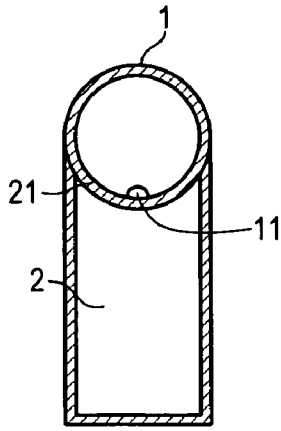
FIG. 2 is a cross-section view along a section A-A.
Figure 3:
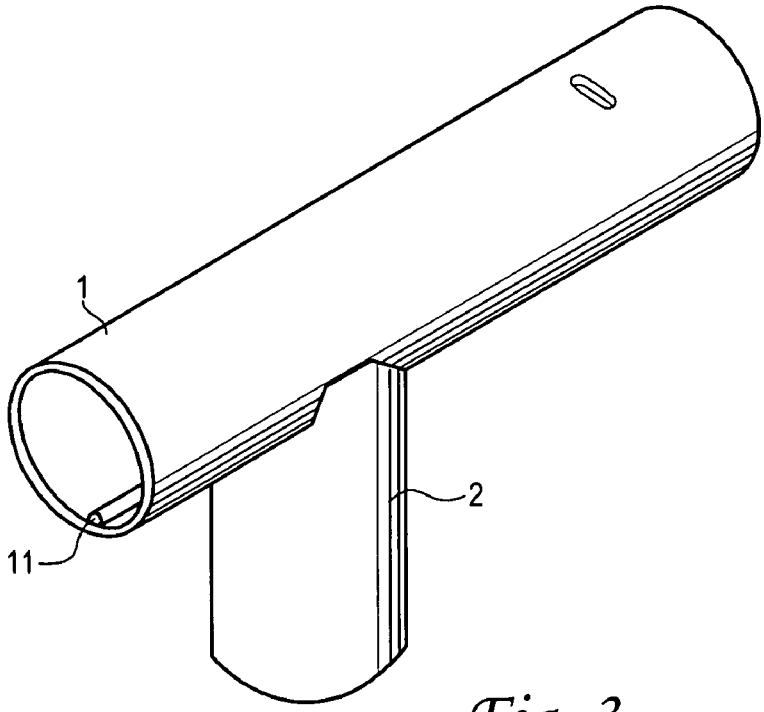
FIG. 3 is a perspective view of a first embodiment of the invention.

The figures are explained as follows. According to FIGS. 1, 2, 3 of the present invention, the main portion is a welding together of the main tube 1 and the support tube 2. The main tube 1 has a straight welded seam 11 formed on a bottom edge. The main tube 1 is placed on the support tube 2 so that the support tube 2 has an upper end of the support tube forming a concave saddle for seating the bottom part of the main tube 1 with an outer surface forming a concave depression 21 in the shape of an arc scoop channel. The support tube is welded to the main tube.

Figure 4:
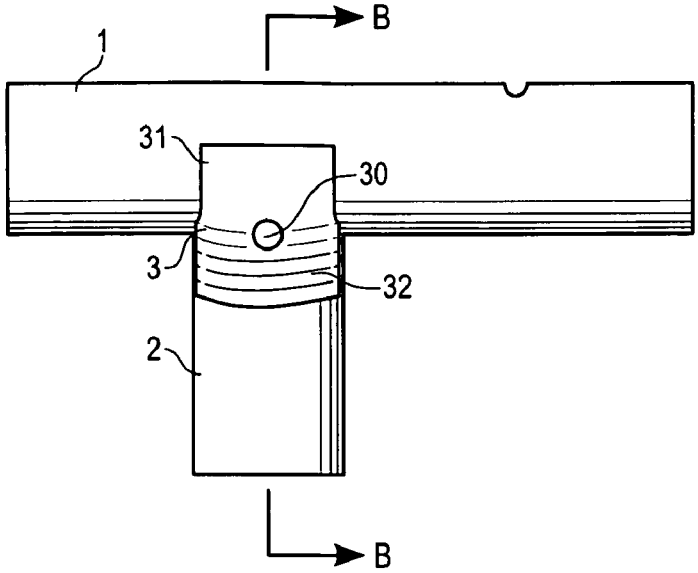
FIG. 4 is a side view of the second embodiment.
Figure 5:
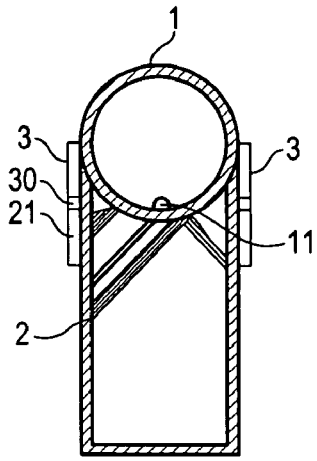
FIG. 5 is a cross-section view along section B-B.
Figure 6:
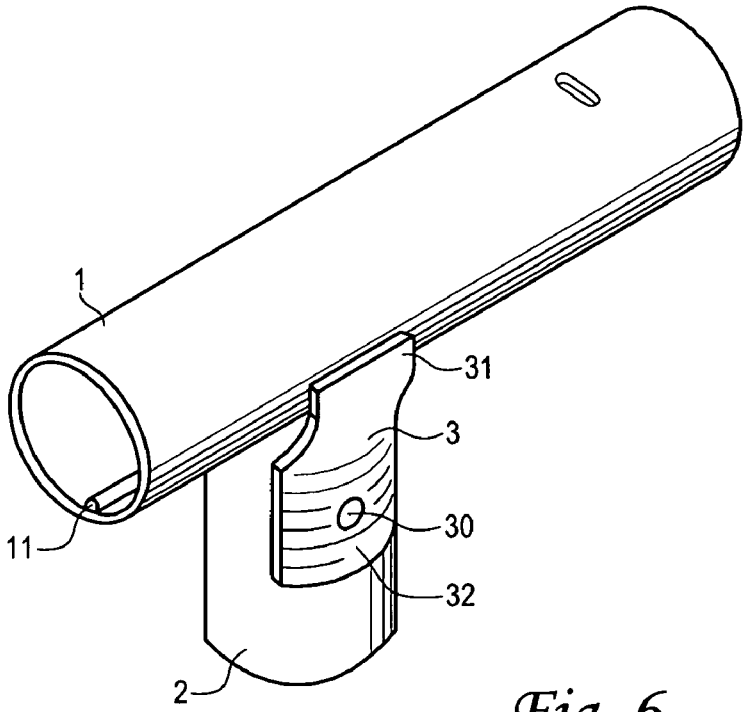
FIG. 6 is a perspective view of the second embodiment.

According to FIGS. 4, 5, 6 in addition to the above embodiment there is added a reinforcing plate 3 welded over main tube 1 and support tube 2's weld seam junction. The reinforcing plate is welded at the connection between main tube 1 and support tube 2.

To ensure that the reinforcing piece and main tube 1 and support tube 2 has good coordination, the reinforcing plate 3 top portion 31 has a concave curvature conforming to and connecting to the horizontal curve of main tube 1. The top portion therefore has a curvature coaxial to main tube. The bottom part 32 of the reinforcing plate 3 conforms to and connects to the curve of the support tube 2. The bottom portion therefore has a curvature coaxial to support tube.

The middle of the reinforcing plate 3 has a through hole 30. When reinforcing piece 3 is welded to the main frame tube 1 and support tube 2 along a peripheral edge of reinforcement piece 3, the through hole 30 posterior margins can be welded so that the reinforcement piece 3 periphery and the through hole 30 posterior margins carry welding, thereby further strengthening the welding structure.

This practical new design features: first an improved welding configuration that provides a low cost and high-efficiency connection. The weld seam on the bottom decreases shock to the weld seam and also prevents interference between the connecting hole on the main pipe and weld seam. Finally, this invention uses a weld seam strengthening piece.

Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A trampoline comprising:

a. a trampoline bed and a trampoline frame having a tubular design;

b. a main tube, wherein the main tube is horizontally oriented and forms a portion of the trampoline frame;

c. a support tube, wherein the support tube is vertically oriented and forms a portion of the trampoline frame, wherein an upper end of the support tube forms a concave saddle for seating the main tube, wherein the support tube is welded to the main tube;

d. a main tube weld formed on a bottom edge of the main tube, wherein the main tube is made from a sheet of metal that is welded together at a bottom edge;

e. a reinforcing plate having a top portion with horizontal curvature matching a curvature of the main tube and a bottom portion having a vertical curvature matching a curvature of the support tube, further comprising a through hole for additional welding, wherein the through hole is circular and has a periphery, wherein the periphery receives a weld joining the periphery of the through hole to the support tube.

2. A trampoline bed main frame welded structure, comprising:

a. a main frame tube;

b. a support tube, wherein the main frame tube is sectional, and connects to the support tube, wherein the support tube has a peak surface formed to mate with the main frame tube, wherein the peak surface has a contour coordinated as an arc scoop channel, wherein the main frame tube has a welded joint located at a lower extremity, wherein welded joint faces the arc scoop channel, wherein over a weld junction between the main frame tube and the support tube, a reinforcement piece is welded over the main frame tube and the support tube.

3. The trampoline bed main frame welded structure of claim 2, further comprising:

a through hole in the middle of the reinforcement piece, wherein a welding position of the reinforcement piece the main frame tube and the support tube is located with a reinforcement piece peripheral boundary, wherein the through hole has a margin welded to the support tube.

4. A trampoline bed main frame welded structure, comprising:

a main frame tube;

a support tube, wherein the main frame tube is sectional, and connects to the support tube, wherein the support tube has a peak surface formed to mate with the main frame tube, wherein the peak surface has a contour coordinated as an arc scoop channel, wherein the main frame tube has a welded joint is located at a lower extremity, wherein welded joint faces the arc scoop channel, wherein a reinforcement piece top portion has a horizontal curvature which coordinates with the main frame tube, and wherein a reinforcement piece lower part has a vertical curvature which coordinates with the support tube, and further comprising a through hole in the middle of the reinforcement piece, wherein a welding position of the reinforcement piece the main frame tube and the support tube is located with a reinforcement piece peripheral boundary, wherein the through hole has a margin welded to the support tube.

* * * * *